US008146774B2

(12) United States Patent
Parker et al.

(10) Patent No.: US 8,146,774 B2
(45) Date of Patent: Apr. 3, 2012

(54) GRAB BAR FOR A WASTE CONTAINER

(75) Inventors: Brian G. Parker, Alto, MI (US); Michael A. Barrett, Lyons, MI (US); Larry Kooiker, Holland, MI (US)

(73) Assignee: Cascade Engineering, Inc., Grand Rapids, MI (US)

( * ) Notice: Subject to any disclaimer, the term of this patent is extended or adjusted under 35 U.S.C. 154(b) by 434 days.

(21) Appl. No.: 12/404,666

(22) Filed: Mar. 16, 2009

(65) Prior Publication Data

US 2010/0230427 A1 Sep. 16, 2010

(51) Int. Cl.
*B65D 35/32* (2006.01)

(52) U.S. Cl. ..... 220/757; 220/751; 220/759; 220/762; 220/770; 220/908

(58) Field of Classification Search ..... 220/751, 220/756, 757, 759, 762, 764, 770, 908; 29/428
See application file for complete search history.

(56) References Cited

U.S. PATENT DOCUMENTS

| | | | | |
|---|---|---|---|---|
| 3,164,402 | A * | 1/1965 | Jobe | 403/243 |
| 7,172,088 | B2 * | 2/2007 | McDade et al. | 220/23.87 |
| 2004/0108320 | A1 * | 6/2004 | Brletich et al. | 220/787 |
| 2009/0293667 | A1 * | 12/2009 | Ogburn | 74/551.8 |

* cited by examiner

*Primary Examiner* — Anthony Stashick
*Assistant Examiner* — Madison L Wright
(74) *Attorney, Agent, or Firm* — Warner Norcross & Judd LLP

(57) ABSTRACT

A waste cart includes a container having a wall, with a pocket formed in an outer surface of the wall that creates a first sidewall facing a second sidewall, with an opening formed in both sidewalls. A grab bar has a free-sliding end and a retention end. The free-sliding end is inserted through the opening in the first sidewall, and the retention end is inserted through the opening in the second sidewall. The retention end includes a retainer for securing the grab bar with respect to the second sidewall. In the current embodiment, the grab bar includes a snap element near the retention end and a flange portion between the snap element and the free-sliding end. When the grab bar is installed, a portion of the second sidewall is positioned between the snap element and the flange portion.

15 Claims, 5 Drawing Sheets

GRAB BAR FOR A WASTE CONTAINER

BACKGROUND OF THE INVENTION

The present invention relates to waste containers, and more particularly to waste containers including grab bars.

Wheeled waste carts and other waste containers are well known and are commonly used in residential areas. The bags of waste that a resident accumulates throughout a given week are typically stored in a waste cart. On a scheduled day, the resident will wheel the cart containing the waste bags down to the curb for pickup by a waste truck so that the contents of the waste cart can be dumped into the truck. The dumping may occur manually or using machinery on the truck that is adapted to automatically lift the waste cart, turn the cart over and dump its contents into the truck. On some trucks, the machinery includes arms that grasp and squeeze the sides of the cart. On other trucks, the machinery includes a hook or gripper that interfits with a handle or grab bar on the cart.

The grab bar is typically formed from metal, fiberglass or plastic. The bar extends through openings in the sides of a pocket formed in the sidewall of cart. To prevent the ends of the bar from sliding back through either of the openings, the bar is typically long enough so that the ends of the bar reach or nearly reach the inner surfaces of the sides of the cart. However, when the arms on the truck machinery grasp the sides of the cart, the arms may squeeze the cart so tightly that the ends of the bar are forced through the sides of the cart, thus creating undesirable punctures in the sides of the cart.

Alternatively, and especially with shorter bars, retainer pins or/or clips can be used to secure the grab bars within the cart. The pins and clips can be secured to the bar after the ends of the bar have been inserted through the openings in the cart. Because the clips and pins prevent the ends of the bar from sliding back through the openings, the bar can be shorter, and consequently the ends of the bar are less likely to puncture the sides of the cart when the cart is squeezed. However, the clips and pins create additional pieces that must be manufactured, inventoried, and installed, thus adding cost. These additional pieces may also be lost, rendering the bar useless without them.

SUMMARY OF THE INVENTION

The aforementioned problems are overcome in the present invention in which a one-piece grab bar includes integral attachment structure for securing the bar within a waste container.

In the current embodiment, the grab bar includes a free-sliding end and a retention end. The free-sliding end may be inserted through the first opening in the container, and the retention end is inserted through the second opening in the container. The retention end includes integral structure for retaining the grab bar with the container.

Preferably, the retaining structure includes a snap element and a flange that both extend radially outwardly beyond the outer surface of the grab bar. The snap element is positioned near the retention end of the grab bar and is adapted to travel between an extended position and a depressed position. The flange is positioned between the snap element and the free-sliding end of the grab bar. As the bar is installed in the container, an edge of the second opening presses the snap element into the depressed position to allow the grab bar to pass through. The snap element returns to the extended position after it exits the opening, so that a portion or section of the container wall is positioned between the snap element and the flange. In this configuration, the flange prevents the grab bar from being pushed further through the opening, and the snap element prevents the grab bar from being pulled out of the opening, such that the grab bar is securely retained to the container.

Thus, the grab bar of the present invention can be securely and reliably joined with a waste cart to withstand the rough handling by the automated lifting equipment on a waste truck. The connection feature eliminates the need for the bar to be so long that the ends of the bar nearly touch the inner surfaces of the sides of the cart. Thus, the ends of the grab bar will not be forced through the sides of the cart when the cart is squeezed. Additionally, the bar can be formed in one piece, which eliminates the need for separate clips or pins or any other additional pieces. Further, the bar can be more easily and safely installed and removed from the cart, and can be interchanged with other replacement bars or replacement carts.

These and other objects, advantages, and features of the invention will be more fully understood and appreciated by reference to the description of the current embodiment and the drawings.

DESCRIPTION OF THE CURRENT EMBODIMENT

Figure 1:
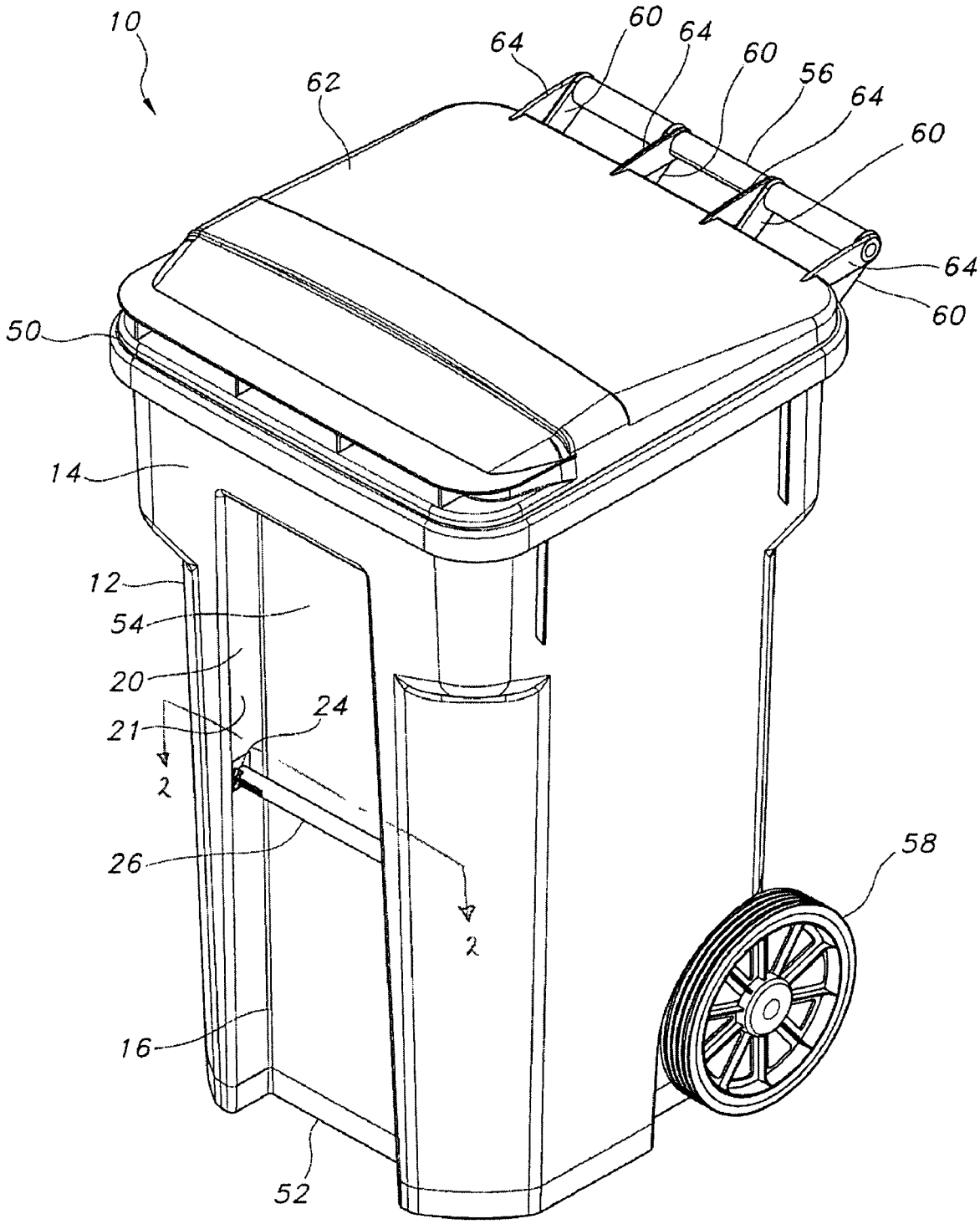
FIG. 1 is a perspective view of a waste cart having a grab bar in accordance with the present invention.
Figure 2:
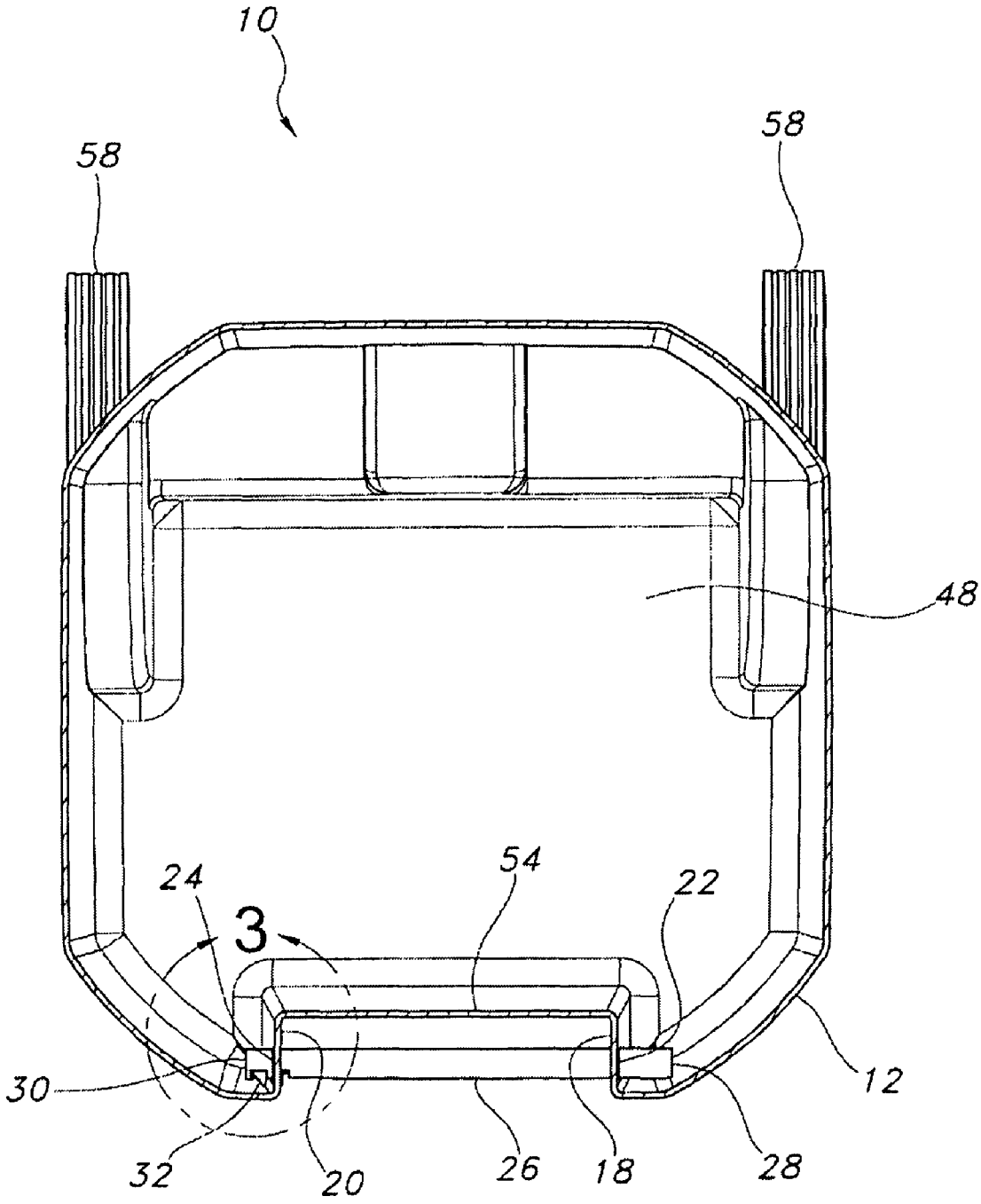
FIG. 2 is a sectional view taken along line 2-2 in FIG. 1.

A wheeled waste container or cart is shown in FIG. 1 and is generally designated 10. The cart 10 includes a container 12 having a front wall 14, with a pocket 16 formed in an outer surface of the wall 14. As shown in FIG. 2, the pocket 16 includes a first sidewall 18 that faces a second sidewall 20. The first sidewall 18 defines an opening 22, and the second sidewall 20 defines an opening 24. The cart 10 includes a grab bar 26 having a free-sliding end 28 and a retention end 30. The length of the grab bar 26 from the free-sliding end 28 to the retention end 30 is longer than the width of the pocket 16 from the first sidewall 18 to the second sidewall 20. The free-sliding end 28 of the grab bar 26 is inserted through the opening 22 in the first sidewall 18, at least until the retention end 30 can be inserted through the opening 24 in the second sidewall 20. The retention end 30 is adapted to join the grab bar 26 with the second sidewall 20 and can do so in any suitable manner.

Figure 3:
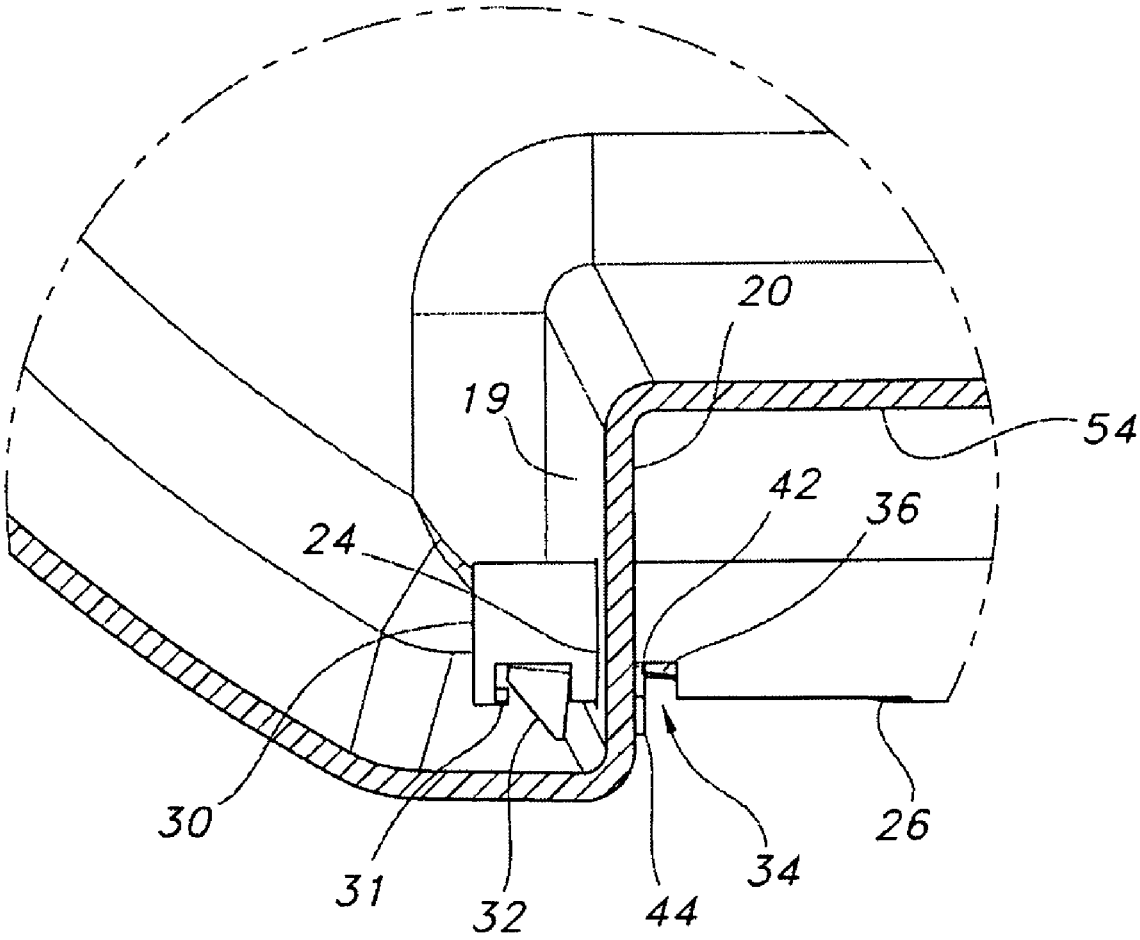
FIG. 3 is an expanded view of the area within line 3 in FIG. 2.
Figure 4:
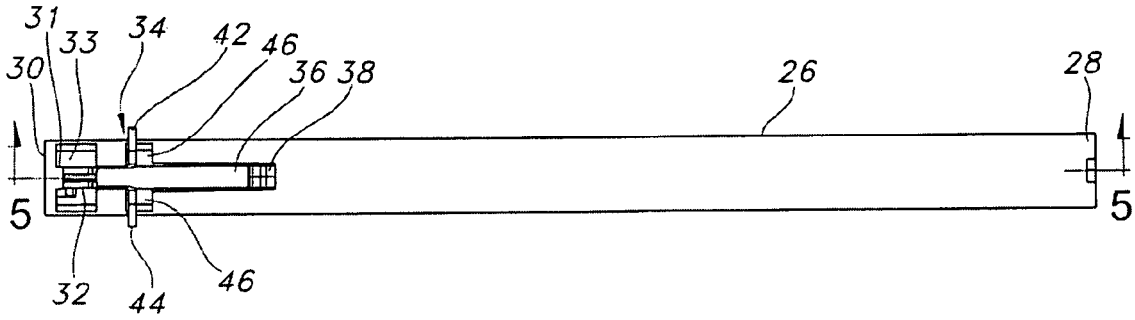
FIG. 4 is a top plan view of the grab bar.
Figure 5:
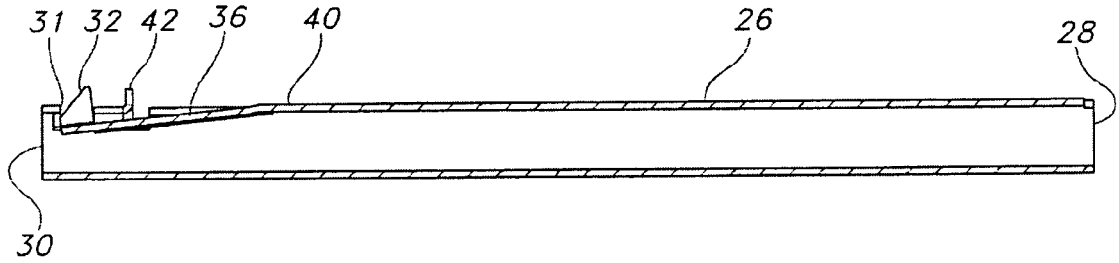
FIG. 5 is a sectional side view of the grab bar taken along line 5-5 in FIG. 4.
Figure 7:
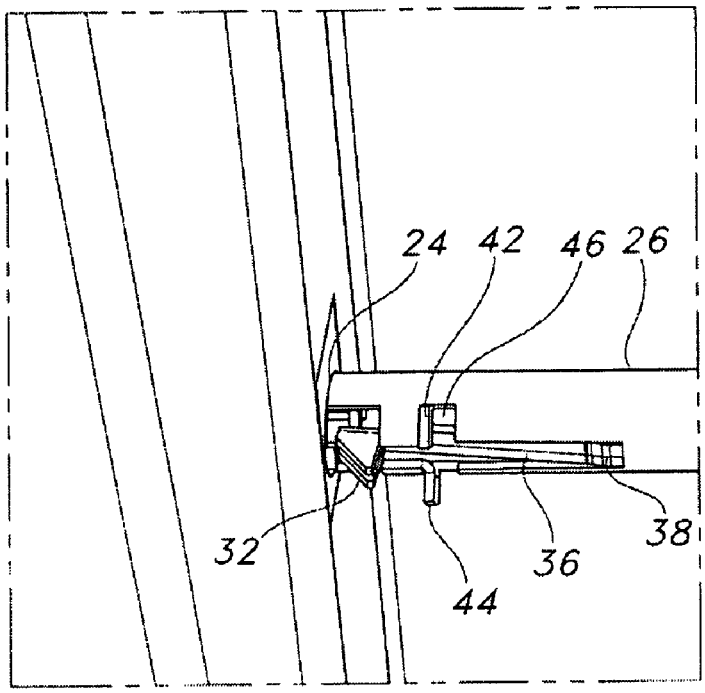
FIG. 7 is a perspective view of the retention end of the grab bar prior to being inserted into an opening in the waste cart.
Figure 8:
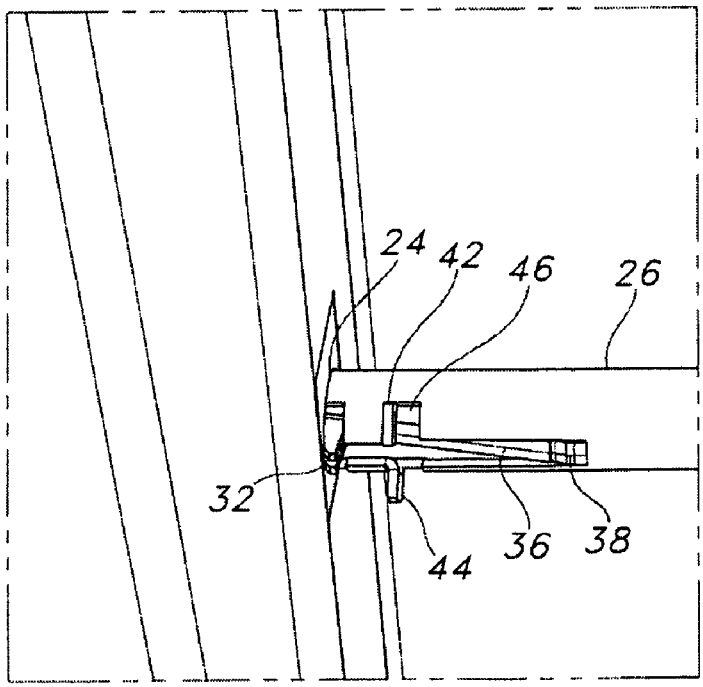
FIG. 8 is a perspective view similar to FIG. 7 showing the retention end partially inserted into the opening in the waste cart.

In the illustrated embodiment, the grab bar 26 includes a snap element 32 positioned near the retention end 30 and a flange 34 positioned between the snap element 32 and the free-sliding end 28. Both the snap element 32 and the flange 34 extend outward beyond an outer surface 40 of the grab bar 26 (FIG. 5). The snap element 32 is adapted to travel between an extended position and a depressed position. As the retention end 30 is inserted through the opening 24, the snap element 32 is depressed by an edge of the opening 24 in the second sidewall 20, to allow the retention end 30 of the grab bar 26 to pass through the opening 24 (FIGS. 7-8). After the snap element 32 exits the opening 24 and moves beyond the second sidewall 20 into the container 12, the snap element 32 is adapted to return to the extended position. Thus, the retention end 30 of the grab bar 26 is "snapped" into the container 12 at the opening 24. In this configuration, at least a portion of the second sidewall 20 is positioned between the snap element 32 and the flange 34 (FIGS. 2-3). The snap element 32 is positioned to engage an inner surface 19 of the second sidewall 20 to prevent the grab bar 26 from being pulled out of the opening 24. The flange 34 is positioned to engage an outer surface 21 of the second sidewall 20 to prevent the grab bar from being pushed further through the opening 24. Thus, the grab bar 26 is securely retained to the container 12.

When the grab bar 26 is secured to the container, the free-sliding end 28 of the grab bar 26 is located inside of the container 12, through the opening 22 in the first sidewall 18 (FIG. 2). In the illustrated embodiment, as shown in FIG. 3, the space between the snap element 32 and the flange 34 allows the grab bar 26 a small amount of movement. However, the flange 34 prevents the free-sliding end 28 of the grab bar 26 from sliding back out through the opening 22 in the first sidewall 18. Thus, the snap element 32 and the flange 34 basically secure the position of the grab bar 26 with respect to the container 12 to prevent the grab bar 26 from being dislodged or disconnected from the container 12.

The grab bar 26 can be formed in any shape and size that is suitable to be connected to the container 12 and grabbed or grasped by a worker or by the machinery on a waste truck for the automatic emptying of the contents of the cart 10. In the illustrated embodiment, the grab bar 26 is formed as a hollow tube having a generally round cross section. The grab bar 26 is sized so that it fits through the opening 24 when the snap element 32 is in the depressed position, but does not fit through the opening 24 when the snap element 32 is in the extended position. The grab bar 26 may be formed from plastic, fiberglass, rolled steel or any other suitable material. The grab bar 26 can optionally be formed using a relatively low-cost stamping process.

The snap element 32 can be formed in any shape and size suitable to engage the inner surface 19 of the second sidewall 20 of the container 12 when the grab bar 26 is joined with the container 12 (FIG. 3). In the illustrated embodiment, the snap element 32 is formed generally in the shape of a right triangle, with a base of the triangle adapted to be joined with the grab bar 26 and the vertical side portion of the triangle adapted to engage the inner surface 19 of the sidewall 20. In the illustrated embodiment, in the extended position, the base of the snap element 32 is positioned below the wall of the grab bar 26, such that the snap element 32 is positioned partially within the grab bar 26 and partially outside of the grab bar 26. To accommodate the snap element 32 in this configuration, the grab bar 26 includes an aperture or cut-out 33 where a portion of the grab bar wall has been removed. The snap element 32 can optionally be formed integrally with the grab bar 26 or can be separately formed and added to the grab bar 26.

The snap element 32 can travel from the extended position to the depressed or lowered position in any suitable manner. In the illustrated embodiment, the snap element 32 is joined with an arm 36, which is flexibly joined with the grab bar 26. The arm 36 is adapted to pivot to allow the snap element 32 to be depressed toward or into the grab bar 26 when pressure is applied to the snap element 32, such as by the edge of the opening 24 in the sidewall 20. The arm 36 is adapted to lower the snap element 32 with respect to the grab bar 26 at least until the snap element 32 is flush with the outer surface 40 of the grab bar 26, although the snap element may not need to be lowered that far to pass through the opening 24. Alternatively, the snap element 32 can be directly connected to the grab bar 26 and can be adapted to move with respect to the grab bar 26 between the extended and depressed positions.

In the illustrated embodiment, the arm 36 is formed as an elongated, recessed portion of the wall of the grab bar 26 and travels lengthwise along the grab bar 26. The arm 36 is flexibly connected to the grab bar 26 by a living hinge 38, which is biased to urge the arm 36 and the snap element 32 into the extended position (FIG. 5). Thus, as the edge of opening 24 in the sidewall 20 presses the snap element 32 into the depressed position, the living hinge 38 is urging the arm 36 and snap element 32 back toward the extended position. After the snap element 32 passes through and exits the opening 24, the living hinge 38 immediately or nearly immediately urges the arm 36 and the snap element 32 back to the extended position. Thus, the snap element 32 and the arm 36 form a spring-type catch or latch. Optionally, the arm 36 and the living hinge 38 can be formed integrally with the grab bar 26.

Figure 6:
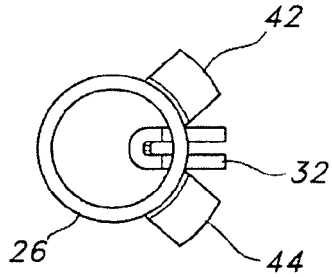
FIG. 6 is an end view of the grab bar.

Optionally, the grab bar 26 may include a feature to prevent the snap element 32 from extending too far down into the grab bar 26. In the illustrated embodiment, the grab bar 26 includes a stop 31 adapted to engage the snap element 32 to limit the downward movement of the snap element toward the depressed position (see FIG. 6). The stop 31 can prevent the snap element 32 from getting stuck in the depressed position and can extend the life of the living hinge 38.

The living hinge 38 is positioned along the grab bar 26 between the flange 34 and the free-sliding end 28. As shown in FIG. 5, the living hinge 38 is positioned near or generally flush with the outer surface 40 of the grab bar 26. The living hinge 38 is biased to maintain the arm 36 at a position in which the arm 36 extends on an angle into a central portion of the grab bar 26. This configuration allows the arm 36 to maintain the snap element 32 in the extended position.

The flange 34 can be formed in any suitable size and shape to engage the outer surface 21 of the second sidewall 20 of the container 12 when the grab bar 26 is joined with the container 12. In the illustrated embodiment, the flange 34 is formed as two separate flange portions 42 and 44, which are formed as protrusions that extend radially outward and generally perpendicular with respect to the outer surface 40 of the grab bar 26 (FIGS. 7-8). In the illustrated embodiment, the flange portions 42 and 44 are fixed and cannot be depressed like the snap element 32, such that the flange portions 42, 44 are not adapted to be inserted through the opening 24. Optionally, the flange portions 42 and 44 can be formed integrally with the grab bar 26. As best shown in FIGS. 7 and 8, the flange portions 42 and 44 are formed from sections of the wall of the grab bar 26 that have been bent or turned outward. The grab bar 26 includes openings or cut-outs 46 where the material of the grab bar wall was removed to form the flange portions 42 and 44. In the illustrated embodiment, the flange portions 42 and 44 are positioned on opposite sides of the arm 36, such that the flange portions 42 and 44 are radially offset from the snap element 32.

The container 12 can be formed in any suitable size and shape. In the illustrated embodiment, the cart 10 is described in connection with a cart adapted to receive and store waste, yard waste, recyclable materials and/or other waste products. However, the container or cart of the present invention can be adapted for the receipt and storage of any other type of goods or products, including any goods that are typically stored in a container that is later emptied by being lifted and turned over. In the illustrated embodiment, the container 12 is generally square-shaped and has rounded edges. The container forms a hollow chamber 48 and includes an open upper end 50, through which the waste products can be placed into the container 12 (FIGS. 1 and 2).

In the illustrated embodiment, the pocket 16 is formed in a front wall 14 of the container 12. However, the pocket 16 could alternatively be formed in any other wall of the container 12 that would be accessible by either a worker or the waste truck. In the illustrated embodiment, the pocket 16 begins at the bottom end 52 of the cart 10, extends vertically along the front wall 14, and ends before it reaches the upper end 50 of the container 12. Alternatively, the pocket 16 could be formed to extend horizontally or diagonally across the wall 14 of the container 12, to vary the placement and orientation of the grab bar 26 on the container. In the illustrated embodiment, the pocket 16 forms a recessed base wall 54 that joins the first and second sidewalls 18 and 20. The pocket 16 is sufficiently deep to provide each of the first and second sidewalls 18 and 20 with a width that can accommodate the respective openings 22 and 24. The first and second sidewalls 18 and 20 are also wide enough to allow the openings 22 and 24 to be spaced from the base wall 54, to provide clearance between the grab bar 26 and the base wall 54 when the grab bar 26 is joined with the container 12 (FIGS. 2 and 3). This clearance allows either a worker or a machine on the waste truck to reach between the grab bar 26 and the base wall 54 to grab or grasp the grab bar 26 to lift the cart 10.

In the illustrated embodiment, the openings 22 and 24 in the first and second sidewalls are positioned generally directly across from each other, such that the grab bar 26 is generally horizontal when it is joined with the container 12. The horizontal configuration may make it easier for the worker or machinery to grab the bar 26. However, as noted above, the grab bar 26 can be joined to the container 12 in a variety of other orientations.

Optionally, the waste cart 10 includes a handle 56 and at least one wheel 58 for transporting the waste cart 10, such as from a house or garage to the curb, so that the waste contained in the cart 10 can be picked up (FIGS. 1 and 2). For example, a user can use the handle 56 to tilt the cart 10 onto the wheels 58 and to push or pull the cart 10. In the illustrated embodiment, the handle 56 is joined with the container 12 by multiple connectors 60 that extend from a rear portion of the upper end 54. The handle 56 and/or connectors 60 may be formed integrally with the container 12.

Optionally, the waste cart 10 includes a lid 62 that is adapted to cover the open end 50 of the container 12. In the illustrated embodiment, the lid 62 is flexibly joined with the container 12 at a rear portion of the upper end 50. The lid 62 includes connectors 64 that extend from the lid 62 and flexibly engage the handle 56 and/or the handle connectors 60. In the illustrated embodiment, the size and shape of the lid 62 corresponds to the size and shape of the open end 50 of the container 12, such that the lid 62 fully covers the open end 50 to close the container 12. The lid 62 and the container 12 may be formed from any suitable material, including plastic, metal or any other suitable material.

To allow the machinery on the waste truck to more easily empty the contents of the cart 10, it may be beneficial to position the pocket 16 and the grab bar 26 on an opposite side of the container 12 from where the lid 62 is secured to the container 12. In this configuration, grab bar fingers on the waste truck machinery are able to catch behind the grab bar 26 with the cart up-ended. Both gravity and the force of the contents of the cart 10 press against the lid 62 to allow the lid 62 to easily open to allow the contents of the cart 10 to pour or fall out of the cart 10 into the waste truck.

The grab bar 26 is removable from the container 12. However, the grab bar 26 must be removed manually or with a tool, such that the grab bar 26 will not likely be inadvertently removed from the container 12 during normal use. Specifically, a person would have to reach into the chamber 48 of the container 12 and manually depress the snap element 32 to allow the grab bar to be pulled back through the opening 24 in the sidewall 20. Alternatively, a person could depress the arm 36 with a suitable tool adapted to disengage or depress the snap element 32. Optionally, to deter theft, a specific tool may be required to depress the snap element.

Because the grab bar 26 is formed separately from the container 12 and can be removed from the container 12, various grab bars can be used interchangeably on various containers. Thus, if the container 12 or lid 62 of the cart 10 were to break or become cracked, the grab bar 26 could be removed from the container 12 and used with another container to form another cart. Similarly, if the grab bar 26 were to become damaged, the damaged grab bar 26 could be removed and replaced with a replacement grab bar.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "the," is not to be construed as limiting the element to the singular.

The embodiments of the invention in which an exclusive property or privilege is claimed are defined as follows:

1. A container comprising:

a container having a wall defining first and second openings separated by a first distance; and a one-piece integral grab bar having a length greater than the first distance, the grab bar including a tubular grab bar wall, a free sliding end supported within the first opening, and a retention end supported and secured within the second opening, the retention end including a releasable retention mechanism integral with the grab bar and adapted to secure the retention end within the opening, the releasable retention mechanism including an arm integral with the grab bar wall and extending toward the interior of the tubular grab bar wall, the arm including an integral snap element.

2. The container of claim 1 wherein:

the grab bar has a generally uniform cross section throughout the length; and the snap element is located near the retention end and adapted to travel between an extended position in which at least a portion of the snap element extends outward beyond the cross section of the grab bar and a depressed position, wherein an edge of the opening in the second sidewall presses the snap element into the depressed position, the snap element being adapted to return to the extended position after the snap element exits the opening.

3. The container of claim 2 wherein the snap element is adapted to engage an inner surface of the second sidewall to prevent the grab bar from traveling out of the opening in the second sidewall.

4. The container of claim 3 wherein the grab bar includes an integral flange located between the snap element and the free-sliding end, wherein at least a portion of the flange extends outward beyond an outer surface of the grab bar, wherein at least a portion of the second sidewall is positioned between the snap element and the flange.

5. The container of claim 4 wherein the flange is adapted to engage an outer surface of the second sidewall to prevent the grab bar from traveling further through the opening in the second sidewall.

6. The container of claim 5 wherein at least a portion of the free-sliding end of the grab bar is located inside the container when the portion of the second sidewall is positioned between the snap element and the flange.

7. The container of claim 6 wherein the arm is flexibly joined with the grab bar, wherein the arm is adapted to flex to move the snap element between the extended and depressed positions.

8. The container of claim 7 wherein the arm is biased to retain the snap element in the extended position.

9. The container of claim 8 wherein the arm is flexibly secured to a wall of the grab bar by a living hinge.

10. A one-piece grab bar for a waste container, the grab bar comprising:

an elongated bar having a tubular wall, a free-sliding end and a retention end, wherein the tubular wall has a generally uniform cross section;

an arm formed integrally with the tubular wall of the elongated bar, the arm extending at least partially into the elongated bar;

a snap element integral with the arm and located near the retention end, wherein the snap element is adapted to travel between an extended position in which at least a portion of the snap element extends radially outwardly beyond the cross section of the tubular wall and a depressed position in which substantially no portion of the snap element extends outwardly beyond the cross section of the tubular wall; and a flange integral with the bar and located between the snap element and the free-sliding end, wherein at least a portion of the flange extends radially outwardly beyond the cross section of the tubular wall.

11. The grab bar of claim 10 wherein the arm is flexibly and integrally connected to the bar, wherein the arm joins the snap element with the bar and is adapted to flex to allow the snap element to be depressed.

12. A method of forming a container having a one-piece grab bar joined therewith, the method comprising:

forming a container having a wall defining first and second opposed holes a first distance apart;

providing a one-piece grab bar having a tubular grab bar wall, a free-sliding end and a retention end, the grab bar having a length longer than the first distance, wherein the retention end includes an integral retaining mechanism adapted to retain the bar against longitudinal movement, the bar including an arm integral with the grab bar wall and extending into the tubular grab bar wall interior, the arm including a snap element with the arm;

inserting the free-sliding end of the grab bar through the first hole;

inserting the retention end of the grab bar through the second hole;

guiding the retention end of the grab bar through the second hole until the snap element engages the container wall, is flexed inwardly by the container wall, and snaps outwardly behind the container wall to interfit with the wall to prevent longitudinal movement of the grab bar with respect to the wall.

13. The method of claim 12, wherein the snap element is adapted to travel between an extended position in which at least a portion of the snap element extends outward beyond an outer surface of the grab bar and a depressed position.

14. The method of claim 13 wherein the guiding the retention end of the grab bar step includes allowing an edge of the second hole to press the snap element into the depressed position and further guiding the retention end of the grab bar through the second hole until the snap element exits the second hole and returns to the extended position.

15. The method of claim 14 further comprising forming a flange portion on the grab bar between the snap element and the free-sliding end, wherein at least a portion of the flange extends outward beyond the outer surface of the grab bar, wherein at least a portion of the wall is positioned between the snap element and the flange portion.

* * * * *